US007772981B1

(12) United States Patent
Lambert et al.

(10) Patent No.: US 7,772,981 B1
(45) Date of Patent: Aug. 10, 2010

(54) NON-REMOVABLE CLOSURE WITH INTEGRAL RFID

(75) Inventors: Phil Lambert, Newburgh, IN (US); Mark Branson, Newburgh, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 678 days.

(21) Appl. No.: 11/382,076

(22) Filed: May 8, 2006

(51) Int. Cl.
*G08B 13/14* (2006.01)

(52) U.S. Cl. ..... 340/572.8; 340/539.1; 340/539.13; 340/572.9

(58) Field of Classification Search ..... 340/539.1, 340/539.13, 568.1, 571, 572.8, 572.9, 693.5, 340/693.12
See application file for complete search history.

(56) References Cited

U.S. PATENT DOCUMENTS

| | | | |
|---|---|---|---|
| 1,563,731 | A | 12/1925 | Ducas |
| 3,409,129 | A | 11/1968 | Sperry |
| 4,497,765 | A | 2/1985 | Wilde et al. |
| 4,510,490 | A | 4/1985 | Anderson, III et al. |
| 4,598,276 | A | 7/1986 | Tait |
| 4,601,404 | A | 7/1986 | Shivers |
| 4,711,368 | A | 12/1987 | Simons |
| 4,801,929 | A | 1/1989 | Instance |
| 4,813,564 | A | 3/1989 | Cooper et al. |
| 4,847,597 | A | 7/1989 | Dobosi et al. |
| 5,566,441 | A | 10/1996 | Marsh et al. |
| 5,625,347 | A | 4/1997 | MacLean et al. |
| 5,678,925 | A | 10/1997 | Garmaise et al. |
| 5,743,426 | A | 4/1998 | Mosley |
| 5,788,099 | A | 8/1998 | Treu et al. |
| 5,790,029 | A | 8/1998 | Curnutte et al. |
| 5,852,590 | A | 12/1998 | De La Huerga |
| 6,031,457 | A | 2/2000 | Bonkowski et al. |
| 6,045,652 | A | 4/2000 | Tuttle et al. |
| 6,137,413 | A | 10/2000 | Ryan, Jr. |
| 6,239,712 | B1 | 5/2001 | Hawk |
| 6,259,654 | B1 | 7/2001 | De La Huerga |
| 6,271,753 | B1 | 8/2001 | Shukla |
| RE037,406 | E | 10/2001 | Behrmann et al. |
| 6,353,391 | B1 | 3/2002 | Shearer |
| 6,366,260 | B1 | 4/2002 | Carrender |
| 6,418,283 | B1 | 7/2002 | Wegman et al. |
| 6,424,315 | B1 | 7/2002 | Glenn et al. |
| 6,501,382 | B1 | 12/2002 | Rehfus et al. |
| 6,504,481 | B2 | 1/2003 | Teller |
| 6,529,446 | B1 | 3/2003 | De La Huerga |
| 6,592,043 | B1 | 7/2003 | Britton |
| 6,641,052 | B2 | 11/2003 | Baillod et al. |
| 6,646,328 | B2 | 11/2003 | Tsai |
| 6,707,763 | B2 | 3/2004 | Osberg et al. |
| 6,782,601 | B2 | 8/2004 | Smeyak et al. |
| 6,831,552 | B2 | 12/2004 | Lin |

(Continued)

*Primary Examiner*—Daryl Pope
(74) *Attorney, Agent, or Firm*—Chad D. Bruggeman; John F. Salazar; Middleton Reutlinger

(57) ABSTRACT

A non-removable closure having a radio frequency identification, RFID, circuit integral therein. The RFID may be active or passive and may be integral with the top wall or side wall of the closure. The non-removable closure has a closure retainer which non-removeably engages a container neck at to which it is engaged. The closure retainer may be in the form of "J" hooks depending from the bottom portion of a side wall, an adhesive between the container neck and closure, or other closure retainer known to persons having ordinary skill in the art.

21 Claims, 6 Drawing Sheets

U.S. PATENT DOCUMENTS

| | | | | |
|---|---|---|---|---|
| 6,845,064 | B2 | 1/2005 | Hildebrandt | |
| 6,879,876 | B2 | 4/2005 | O'Dougherty et al. | |
| 6,897,827 | B2 | 5/2005 | Senba et al. | |
| 6,982,640 | B2 | 1/2006 | Lindsay et al. | |
| 6,992,586 | B2 | 1/2006 | Rosenfeld | |
| 7,070,053 | B1 * | 7/2006 | Abrams et al. | 206/459.5 |
| 7,088,249 | B2 | 8/2006 | Senba et al. | |
| 7,364,089 | B2 * | 4/2008 | Claessens et al. | 235/492 |
| 2001/0028308 | A1 | 10/2001 | De La Huerga | |
| 2002/0185544 | A1 | 12/2002 | Baillod et al. | |
| 2003/0004608 | A1 | 1/2003 | O'Dougherty et al. | |
| 2003/0020613 | A1 | 1/2003 | Cosnard | |
| 2003/0043039 | A1 | 3/2003 | Salemi et al. | |
| 2003/0058110 | A1 | 3/2003 | Rich | |
| 2003/0061705 | A1 | 4/2003 | Smeyak et al. | |
| 2003/0061706 | A1 | 4/2003 | Smeyak et al. | |
| 2003/0071725 | A1 | 4/2003 | Teller | |
| 2003/0074725 | A1 | 4/2003 | Pino | |
| 2003/0099158 | A1 | 5/2003 | De la Huerga | |
| 2003/0235027 | A1 | 12/2003 | Smeyak et al. | |
| 2004/0008123 | A1 | 1/2004 | Carrender et al. | |
| 2004/0032330 | A1 | 2/2004 | Hoffman | |
| 2004/0046020 | A1 | 3/2004 | Andreasson et al. | |
| 2004/0069850 | A1 | 4/2004 | De Wilde | |
| 2004/0070504 | A1 | 4/2004 | Brollier et al. | |
| 2005/0051624 | A1 * | 3/2005 | Kipp et al. | 235/385 |
| 2005/0110647 | A1 | 5/2005 | Ritson | |
| 2005/0128087 | A1 | 6/2005 | Claessens et al. | |
| 2005/0224445 | A1 * | 10/2005 | Gancia | 215/204 |
| 2006/0049948 | A1 | 3/2006 | Chen et al. | |
| 2006/0180650 | A1 * | 8/2006 | Claessens et al. | 235/375 |
| 2007/0182564 | A1 | 8/2007 | Abbott | |
| 2007/0267383 | A1 | 11/2007 | McGeough et al. | |
| 2007/0289934 | A1 * | 12/2007 | Gancia | 215/201 |

* cited by examiner

NON-REMOVABLE CLOSURE WITH INTEGRAL RFID

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

The present invention generally relates to packaging having a radio frequency identification (RFID) therein for relaying information regarding the packaging and/or contents thereof. More specifically, the present invention relates to closures for containers having an RFID.

BACKGROUND OF THE INVENTION

The development of integrated circuitry, particularly RFIDs, has permitted use of such devices in a wide range of applications. RFIDs first appeared in tracking and access applications during the 1980s. These wireless systems allow for non-contact reading and are effective in manufacturing and other hostile environments where bar code labels could not survive. RFID has established itself in a wide range of markets including livestock identification and automated sorting systems because of its ability to track moving objects. They can be operated passively or actively. While both use radio frequency energy to communicate between a tag and a reader, the method of powering the tags is different. Active RFIDs use an internal power source (battery) within an RFID tag to continuously power the RFID, whereas passive RFIDs rely on energy transferred from the reader to the RFID tag to power the RFID.

Passive RFIDs have a limited communication range since they need a strong signal to be received to power the RFID and to respond to the reader, limiting the reader range to 3 meters or less. Active RFIDs have operating ranges of 100 meters or more and thousands of tags can be read from a single reader. Other advantage of active RFIDs is the ability to monitor environmental or status parameters using an RFID with built-in sensors for detecting such things as temperature, humidity, shock, even tampering. Even though passive RFIDs are unable to continuously monitor the status of a sensor since they only have power when read, they can provide very useful information as to the contents of the container or even simple tamper detection. Therefore, both active and passive RFIDs have found a wide range of applications in packaging.

Recently, RFIDs have been used in a product packaging such as containers and closures. The utilization of an RFID with a closure and container combination has a wide variety of applications, including identification of contents, product promotions, storage and dissemination of product information including product processing, quality assurance, including tamper-indication. U.S. Pat. No. 6,859,745, filed Apr. 17, 2002, issued to Carr et al., discloses a product package including a closure and container, wherein the closure has an active RFID mounted thereon. The RFID is disposed on an interior surface of the package. However, a problem existing with this and other current applications of RFIDs in closures is that the RFID can be damaged from the contents of the container; the closure having the RFID can be removed from the container; the RFID can be removed from the container or closure, altered, switched, or tampered with in other ways.

SUMMARY OF THE INVENTION

The present invention is of a closure having at least a portion of which is non-removable, having an RFID integral therein. The term integral as used herein means adhered to or contained in a part of the closure. The term non-removable as used herein means the closure has a portion or component part that has a non-disengaging resistance to removal from a closure to which it is attached, as opposed to a disengaging resistance to removal as in a child-resistant closure. The non-removable closure can have a dispenser, flip-top, push-pull top, second child resistant closure, second standard threaded closure, penetrable top wall, or other means known by persons having ordinary skill in the art for accessing the contents of a container to which it becomes non-removably attached. The closure has a closure retainer for non-removeably attaching at least a portion of the closure to a container neck wherein the closure retainer may be in the form of "J" hooks depending from the opening edge of an annular side wall, epoxy or other adhesive between the inner annular surface of the side wall and container neck, heat or induction sealing, ultra sonic welding, or other means known in the art. Similar and other means can be used to make an RFID a non-removable integral part of the closure such as placing an RFID into a mold prior to the injection of polymeric materials forming the closure around the RFID.

BRIEF DESCRIPTION OF THE DRAWINGS

Reference to the figures discloses several embodiments of the present invention and is not to be interpreted as limiting the scope of the present invention.

DETAILED DESCRIPTION OF THE PREFERRED EMBODIMENTS

The following detailed description is given primarily for clearness of understanding and no unnecessary limitations are to be understood there from and modifications will become obvious to those skilled in the art upon reading the disclosure and may be made without departing from the spirit of the invention and scope of the appended claims.

Figure 1:
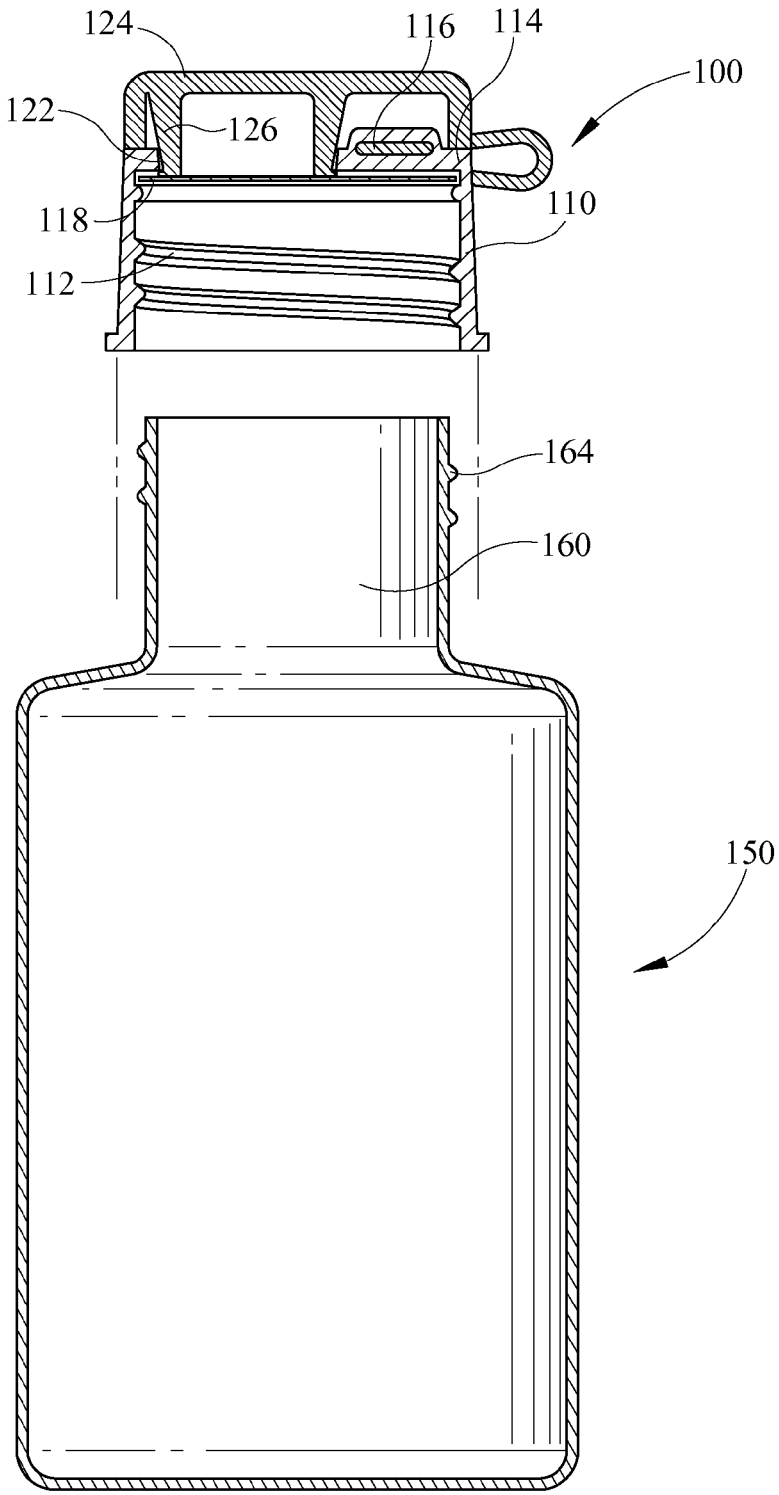
FIG. 1 is cross-sectional view of a non-removable closure and container combination wherein the closure is a flip-top closure having an RFID disposed within a top wall and has a seal covering a lower surface thereof.

FIG. 1 shows non-removable closure 100 and container 150 wherein closure 100 has RFID 116 integral with top wall 114. Closure 100 is a flip-top type closure having top wall 114 with annular depending side wall 110. Side wall 110 has helical thread 112 depending from an inner annular surface thereof for engaging helical thread 164 on container neck 160 of container 150. Side wall 110 has closure retainer 120 depending axially from the end opposite top wall 114. Closure retainer 120 cooperates with locking rim 162 depending from a lower outer surface of container neck 160 for locking closure 100 onto container 150 when closure 100 is sealed onto container 150. Such a configuration is an example of an embodiment of a non-removable closure. Other embodiments of the present invention incorporate mechanical grips, crimping, double-sided heat sealing, epoxy, ultra sound welding, or gluing closure 100 onto container 150. There are a variety of means known to persons having ordinary skill in the art for making closure 100 a non-removable closure, all of which are within the scope of the present invention.

Top wall 114 of closure 100 has integral RFID 116 with a lower surface substantially flush or slightly depending from a lower surface of top wall 114. Adjacent the lower surface of top wall 114 and RFID 116 is seal 118. Seal 118 is comprised of a material that can be punctured (i.e. foil and plastic) allowing the contents of container 150 to exit through aperture 122 in top wall 114. Preferably, seal 118 is comprised of a polymeric material as to not interfere with the radio communication with RFID 116. Hingedly depending from top wall 114 is flip-top 124 having depending sealing post 126 for sealing aperture 122.

RFID 116 may be an active or passive RFID. RFID 116 typically contains at least content identification information but may also have sensors and data read therefrom such as temperature, shock, tamper-indication, product quality assurance, and may also have additional information such as product promotions or any variety of information that may be deemed appropriate.

RFID 116 may become integral with closure 100 in a variety of ways. For instance, a foil layer may be combined in the liner material 118 to transfer heat and melt liner material 118 when bonding to the top wall 114. This is accomplished through induction heating wherein the resistance of the foil layer in liner 118 caused by an induction field creates sufficient heat to cause a plastic layer in liner 118 to melt and bond with the closure top wall 114. Liner 118 needs be comprised of a penetrable material so that the contents of container 100 can be in flow communication with aperture 122 in top wall 114. When a foil layer is used, it is important that it not completely surround RFID 116 so that it does not interfere with reading RFID 116. Alternatively, glue or other adhesive may be applied to the upper surface of liner 118 for adhesion of seal liner 118 into the closure 100. Additionally, RFID 116 may become integral with closure 100 by being melted or glued within top wall 114. Alternatively, no glue may be needed to hold liner 118 or RFID 116 in the closure. Most closures are comprised of a thermoplastic material and are made through a molding process. RFID 116 may become integral with closure 100 by forcefully applying RFID 116 to closure 100 while closure 100 is still in a flowing state after the molding process. RFID 116 may become affixed and integral with closure 100, preventing tampering, by a variety of other methods such as double-sided heat sealing, epoxy, ultra sound welding, making RFID a non-removable permanent part of closure 100. With many of these methods it is not necessary to have seal 118 to make RFID 116 integral with closure 100, making seal 118 optional.

Figure 2:
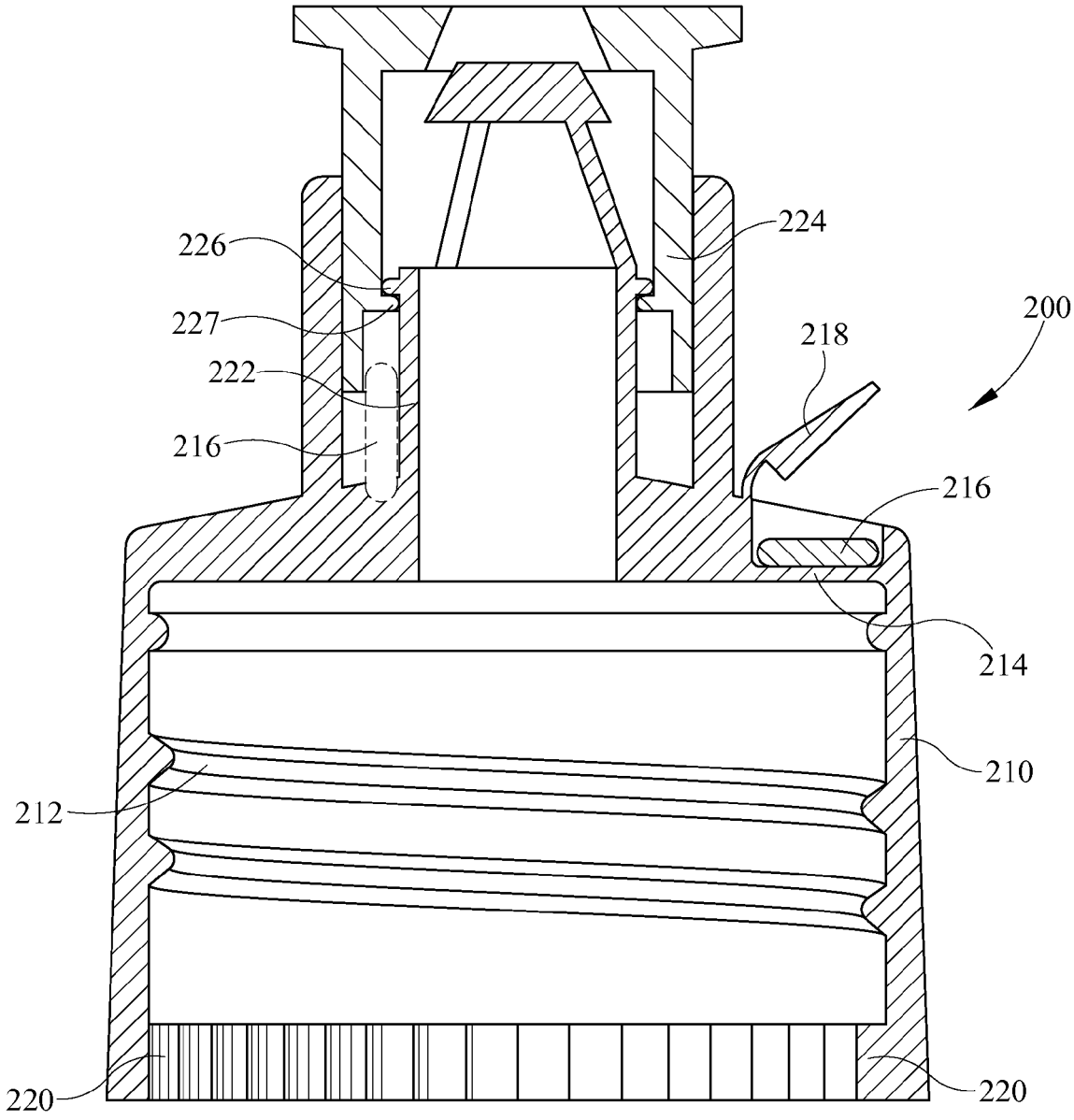
FIG. 2 is cross-sectional view of a non-removable closure wherein the closure is a pull-top closure having an RFID disposed within a top wall.

FIG. 2 shows non-removable pull-top closure 200 having RFID 216 integral with top wall 214. Closure 200 optionally has plug 218 hingidly attached to top wall 214 for sealing a cavity in top wall 214. The optional cavity formed in top wall 214 optionally circumscribes a portion of RFID 216 where plug 218 is attached. RFID 216 is made integral with closure 200 where plug 218 is attached within top wall 214 with adhesives, heat, or other means to form closure 200 having RFID 216 integral within top wall 214. Depending from the top wall 214 is dispensing post 222 having movable seal 224 forming a pull-top closure. Movable seal 224 has bead seal 227 depending from an inner annular wall which cooperates with bead seal 226 depending from an outer annular wall of post 222. Optionally, RFID 216 may reside against dispensing post 222 within a pocket in top wall 214. Closure 200 has annular depending side wall 210 with helical thread 212 depending from an inner surface thereof. Side wall 210 has closure retainer 220 depending radially from the open end opposite top wall 214 in the form of ramps. Closure retainer 220 cooperates with locking ramps depending radially from a lower outer surface of a container neck for locking closure 200 onto a container making closure 200 a non-removable closure. Alternatively, closure 200 could be held to a container with mechanical grips, crimping of closure 200, adhesives, heat or induction sealing.

Figure 3:
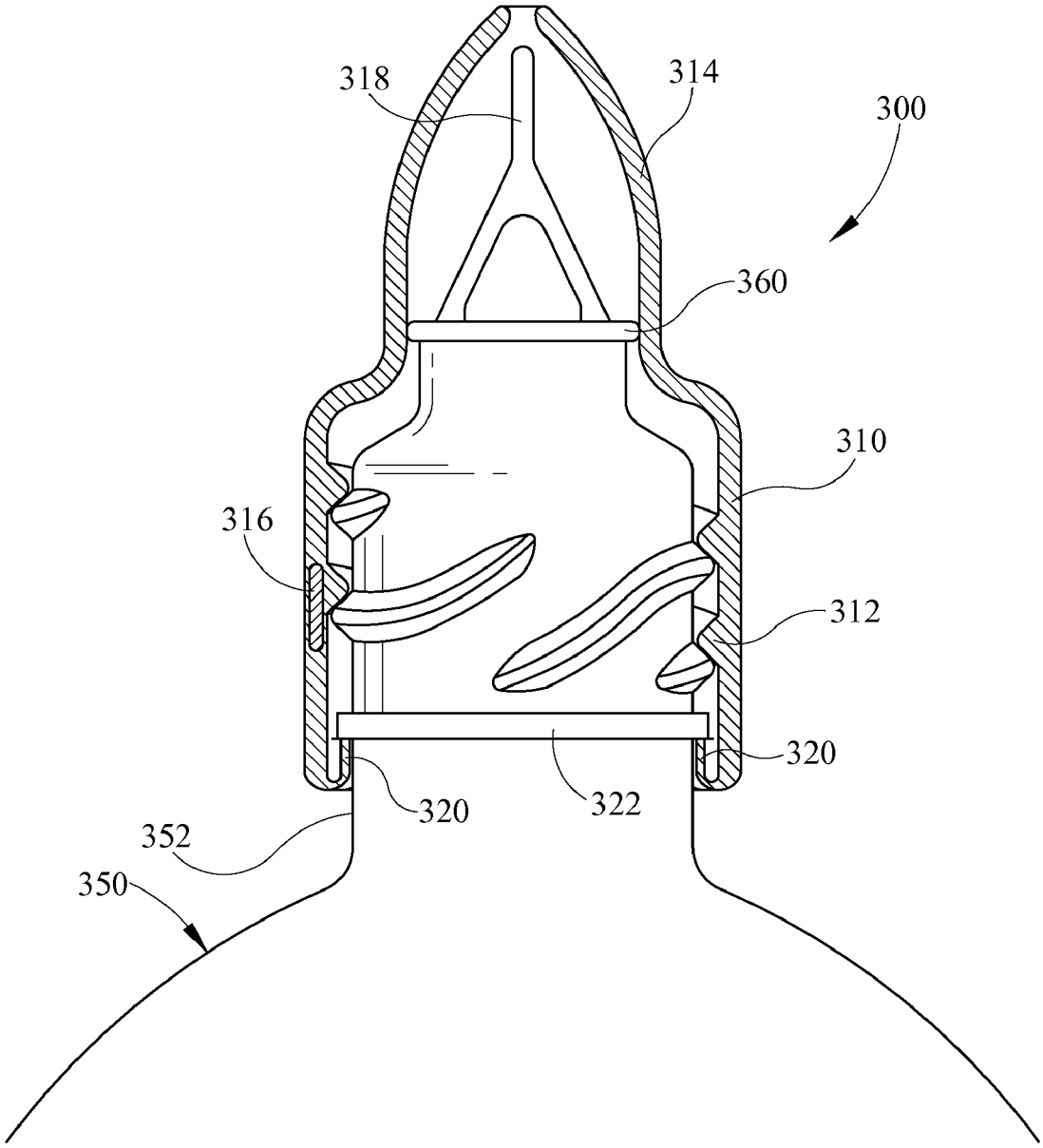
FIG. 3 is cross-sectional view of a non-removable closure wherein the closure is a dispenser type closure having an RFID disposed within a side wall.

FIG. 3 shows closure 300 having RFID 316 integral with side wall 310. Closure 300 is a dispensing closure having top wall 314 of a dome like configuration with a central aperture. Top wall 314 has annular depending side wall 310 with helical thread 312 depending from an inner surface thereof. Side wall 310 has closure retainer 320 depending axially from the open end opposite top wall 314 for engaging container neck retaining ring 322 making closure 300 a non-removable closure. Closure 350 has depending sealing post 318 which seals the central aperture in top wall 314 when in a sealing position. Container 350 has sealing ring 360 depending from container neck 352 which seals with an inner annular surface of top wall 314. Top wall 314 is formed around RFID 316. This is typically accomplished by providing a mold assembly, including a male and female mold part which together defines a mold cavity. Closure formation can be effected by either injection molding or compression molding, as is known in the art. RFID 316 is positioned within the mold cavity and can be maintained in position prior to closure molding such as by the application of a vacuum to RFID 316. Closure 300, typically comprising a polymeric material, is then molded within the mold cavity so that closure 300 is molded generally about RFID 316 which is thus embedded in and integrated with closure 300.

Figure 4:
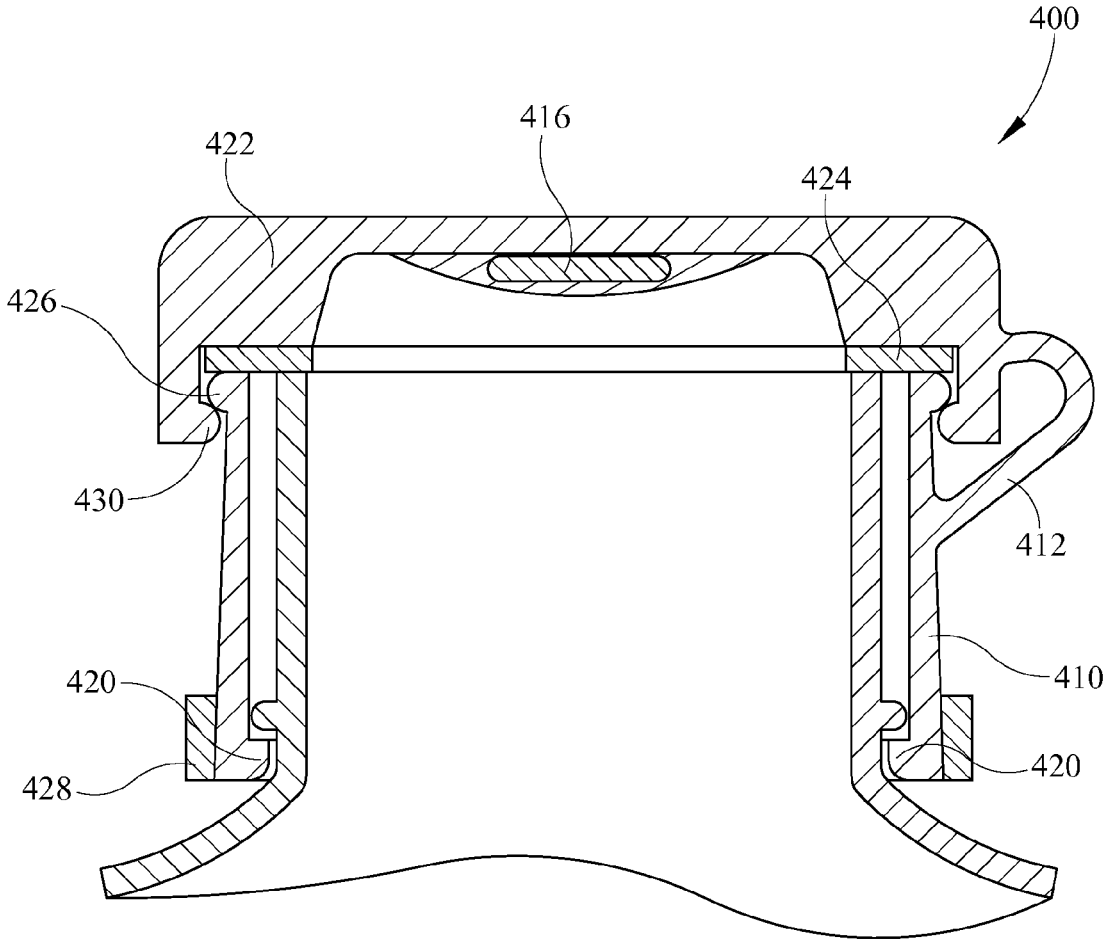
FIG. 4 is cross-sectional view of a non-removable closure wherein the closure is a push-on flip-top closure having an RFID disposed within a top wall.

FIG. 4 shows non-removable closure 400 having RFID 416 integral with top wall 422. Closure 400 has top wall 422 formed around RFID 416. Side wall 410 has closure retainer 420 depending inward from a lower edge thereof for engaging an outwardly depending ring about the neck of a closure. Optional band 428 is shown circumscribing an outer lower surface of side wall 410 and may be applied in the event additional constricting support is needed to cause closure 400 to be a non-removable closure. Band 428 is optional and may be of a polymeric material or may be a metallic crimp on band. Closure 400 is of a push-on type having flip-top 422. Flip-top 422 is hingedly retained by strap or hinge 412 to side wall 410 and functions as a top wall when sealed to side wall 410. Flip-top 422 seals to side wall 410 with inward depending top wall seal 430 cooperating with outward depending side wall seal 426. Also shown here is optional ring gasket 424 for sealing top wall 422 to side wall 410.

Figure 5:
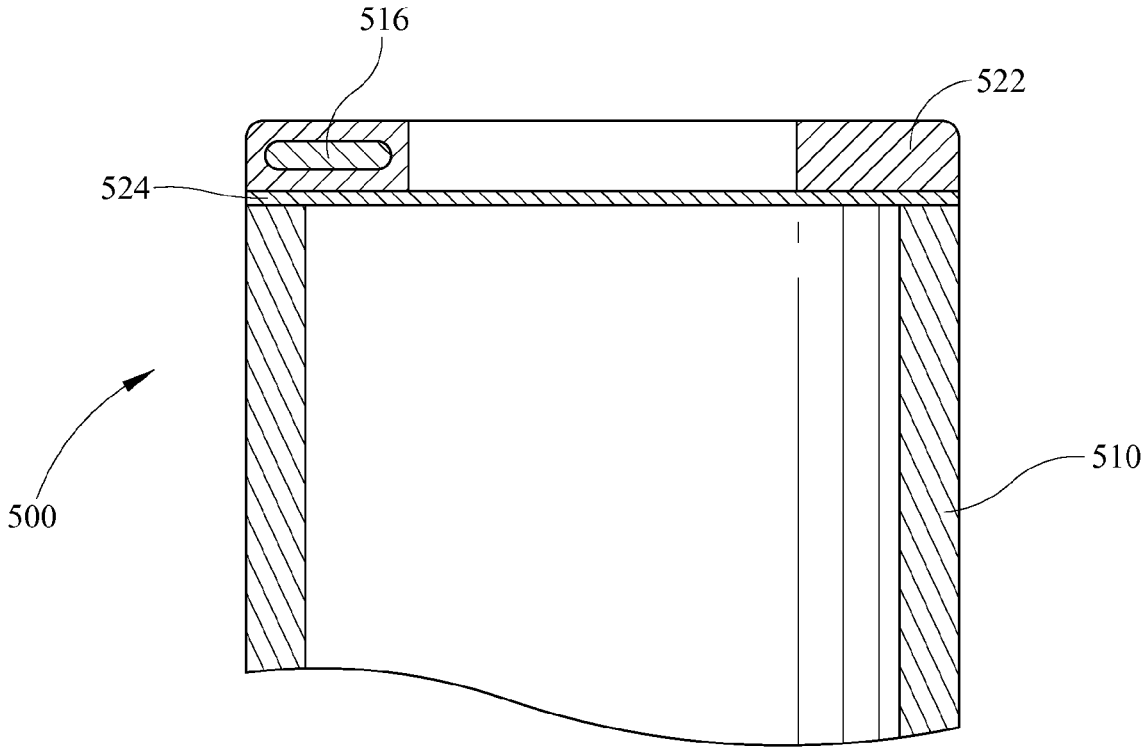
FIG. 5 is cross-sectional view of a non-removable closure wherein the closure has penetrable top wall.

FIG. 5 shows non-removable closure 500 having RFID 516 integral with top wall 522. Closure 500 has top wall 522 in the form of a ring formed around RFID 416. Top wall 522 is retained onto container neck 510 by induction heat sealing thereto where the foil layer 524 forms a penetrable part of a top wall. In a preferred embodiment, foil seal 524 is placed over container neck 510, top wall 522 having RFID 516 integral therein is inductively heat sealed to container neck 510 forming non-removable closure 500 sealing container neck 510 wherein top wall 522 has RFID 516 integral therein and has a penetrable portion formed with foil seal 524.

Figure 6:
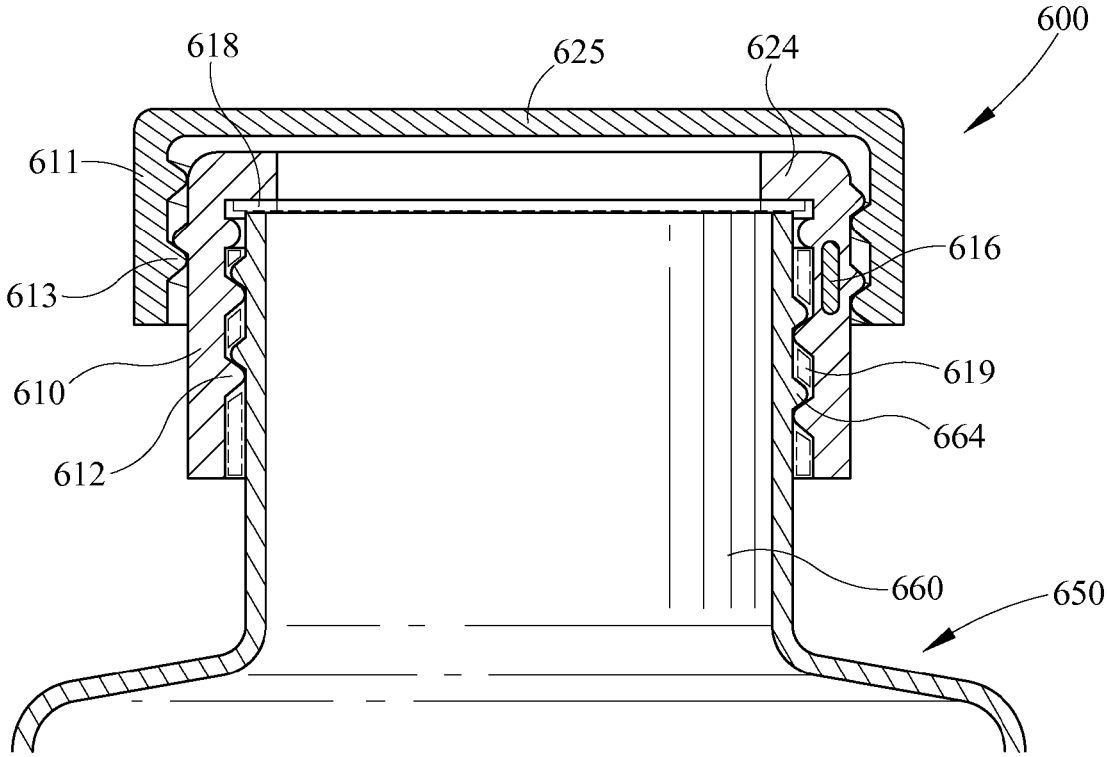
FIG. 6 is cross-sectional view of a non-removable closure wherein the closure has an inner non-removable closure and outer closure.

FIG. 6 shows closure 600 having an inner non-removable closure 610 and an outer removable closure 611. Non-removable closure 610 has RFID 616 integral therein. Removable closure 611 has top wall 625 with a depending annular side wall having helical thread 613 depending therefrom. Non-removable closure 610 has an annular depending side wall formed around RFID 616. Non-removable closure 610 has top wall 624 with an opening therein. Closure 624 may become non-removable by adhering top wall 624 to container neck 660 of container 650 by inductive heat sealing with foil disk 618. Alternatively, closure 610 may become non-removable by adhering the side wall of closure 610 to container neck 660 with an adhesive or inductive heat seal 619. Either means of making closure 610 non-removable on container neck 660 first involves cooperating outer container neck threads 664 with inner annular threads 612 on non-removable closure 610.

The present invention is of a non-removable closure having an integral RFID. The foregoing detailed description is given primarily for clearness of understanding and no unnecessary limitations are to be understood therefrom and modifications will become obvious to those skilled in the art upon reading the disclosure and may be made without departing from the spirit of the invention and scope of the appended claims. The figures show several embodiments of non-removable closures such as dispensing, flop-top, and pull-top closures. This is not to be considered an exhaustive list of non-removable closures as other non-removable closures are considered to be within the scope of the present invention. Additionally, the embodiments of integral means and placement of an RFID within a closure are not to be considered as exhaustive as other means and placement of an RFID within a closure is within the scope of the present invention.

The invention claimed is:

1. A nonremovable flip-top dispensing closure with a hinged lid tethered to an annular skirt comprising:

a base with an annular skirt forming a depending side wall non-removably affixable to a neck finish of a container and having a top wall, said top wall having a dispensing orifice extending through said top wall;

a flip top hingedly engaged to said base and having a top wall and depending side wall, said flip top having a sealing post for engaging said dispensing orifice, said flip top engaging said annular skirt side wall when in a closed position; and said top wall of said base having an upper cavity wall and a lower cavity for integrally retaining an RFID device within said top wall so that said RFID is non-removable from said dispensing closure.

2. The nonremovable flip-top dispensing closure of claim 1 wherein said RFID device is molded within said base of said dispensing closure.

3. The nonremovable flip-top dispensing closure of claim 1 wherein said RFID device is of a passive type.

4. The nonremovable flip-top dispensing closure of claim 1 wherein said annular skirt top wall of said base has an inner surface with a gasket adjacent thereto.

5. The nonremovable flip-top dispensing closure of claim 4 wherein said gasket has a disk configuration and is comprised of a physically penetrable material.

6. The nonremovable flip-top dispensing closure of claim 1 wherein said annular skirt side wall has an inner annular surface with a helical thread depending there from.

7. The nonremovable flip-top dispensing closure of claim 1 wherein said annular skirt side wall forms a non-removable engagement with said container neck finish neck when snapped thereon.

8. The nonremovable flip-top dispensing closure of claim 1 wherein said RFID device is an active RFID in electrical communication with a power source.

9. A nonremovable flip-top dispensing closure with a hinged lid tethered to an annular skirt comprising:

a closure body having an annular skirt having a depending side wall non-removably affixable to a neck finish of a container and having a top wall, said top wall having a dispensing orifice extending through said top wall;

a flip top hingedly engaged to said closure body and having a top wall and depending side wall, said flip top having a sealing post for engaging said dispensing orifice, said flip top engaging said closure body side wall when in a closed position; and said top wall of said flip top having an upper cavity wall and a lower cavity wall for integrally retaining an RFID device within said top wall so that said RFID is integral with said dispensing closure.

10. The nonremovable flip-top dispensing closure of claim 9 wherein said RFID device is an active RFID in electrical communication with a power source.

11. The nonremovable flip-top dispensing closure of claim 9 wherein said RFID device is molded within said dispensing closure.

12. The nonremovable flip-top dispensing closure of claim 9 wherein said RFID device is of a passive type.

13. The nonremovable flip-top dispensing closure of claim 9 wherein said closure body top wall has an inner surface with a gasket adjacent thereto.

14. A nonremovable dispensing closure comprising:

a closure body with an annular skirt having a depending side wall nonremovably affixable to a neck finish of a container and having a top wall, said top wall having a dispensing orifice extending through said top wall;

a sealing post engaging said neck finish, said sealing post operably engaging said dispensing orifice of said closure body top wall wherein said sealing post is axially positionable between a closed position sealing said dispensing orifice and an open position so that the container contents are able to be dispensed from said container; and said closure body having a cavity for integrally retaining an RFID device within said annular skirt so that said RFID is non-removable from said dispensing closure.

15. The nonremovable dispensing closure of claim 14 further includes a threadable engagement between said closure body side wall and said container neck finish so that said dispensing closure is rotated between said closed position and said open position relative to said sealing post.

16. The nonremovable dispensing closure of claim 14 wherein said RFID device is an active RFID in electrical communication with a power source.

17. The nonremovable dispensing closure of claim 14 wherein said RFID device is molded within said dispensing closure.

18. The nonremovable dispensing closure of claim 14 wherein said RFID device is of a passive type.

19. The nonremovable dispensing closure of claim 14 wherein said RFID device is positioned integrally within said closure body side wall.

20. The nonremovable dispensing closure of claim 14 wherein said RFID device is positioned integrally within said closure body top wall.

21. The nonremovable dispensing closure of claim 14 is a single shell closure.

* * * * *